US011175029B1

(12) United States Patent
Zhang et al.

(10) Patent No.: US 11,175,029 B1
(45) Date of Patent: Nov. 16, 2021

(54) LAMP

(71) Applicant: APUTURE IMAGING INDUSTRIES CO., LTD., Shenzhen (CN)

(72) Inventors: Binbin Zhang, Shenzhen (CN); Chongbo Huang, Shenzhen (CN)

(73) Assignee: APUTURE IMAGING INDUSTRIES CO., LTD., Shenzhen (CN)

( * ) Notice: Subject to any disclaimer, the term of this patent is extended or adjusted under 35 U.S.C. 154(b) by 0 days.

(21) Appl. No.: 17/128,732

(22) Filed: Dec. 21, 2020

(30) Foreign Application Priority Data

Apr. 30, 2020 (CN) ..... 202020719224.9

(51) Int. Cl.
*F21V 29/71* (2015.01)
*F21V 15/01* (2006.01)
*F21V 29/74* (2015.01)
*F21Y 115/10* (2016.01)

(52) U.S. Cl.
CPC ..... *F21V 29/713* (2015.01); *F21V 15/01* (2013.01); *F21V 29/74* (2015.01); *F21Y 2115/10* (2016.08)

(58) Field of Classification Search
CPC ..... F21V 29/713; F21V 29/74; F21V 15/01; F21Y 2115/10
See application file for complete search history.

(56) References Cited

U.S. PATENT DOCUMENTS

2011/0051414 A1* 3/2011 Bailey ..... F21K 9/23 362/235
2013/0088871 A1* 4/2013 Yun ..... F21V 29/51 362/249.01
2014/0078737 A1* 3/2014 Lin ..... F21V 29/717 362/249.02
2018/0149349 A1* 5/2018 Shum ..... H05B 45/10
2020/0056764 A1* 2/2020 Baxter ..... F21V 21/30
2020/0386395 A1* 12/2020 Gerard ..... F21V 29/717

* cited by examiner

*Primary Examiner* — Anabel Ton
(74) *Attorney, Agent, or Firm* — The Roy Gross Law Firm, LLC; Roy Gross

(57) ABSTRACT

A lamp includes a housing, a heat sink, a light source and at least a bracket. The heat sink is disposed within the housing. The light source is connected with the heat sink. The bracket is disposed within the housing, and the bracket includes a main body and a first fixing portion arranged along the outer edge of the main body. The main body of the bracket connected to a side surface of the heat sink is connected to the housing through the first fixing portion to dispose the heat sink in the housing. When the bracket is fixedly connected to the inner wall of the housing, the heat sink can be firmly installed inside the housing and it is not easy to loosen during use, so that the heat sink can continuously and stably dissipate for the lamp.

9 Claims, 5 Drawing Sheets

LAMP

PRIORITY CLAIM

This application claims priority to Chinese Patent Application Number 202020719224.9 filed Apr. 30, 2020, the disclosures of which are incorporated in their entirety by reference herein.

FIELD OF INVENTION

This present disclosure generally relates to the technical field of heat dissipation of lamp, and particularly relates to a lamp.

BACKGROUND OF INVENTION

With the development of SSL (Solid-state lighting) technology, such as LED (Light-emitting diode), LED is used as a light source in more and more lamps (such as flashlights, movie lights, stage lights, spotlights, etc.). There are different requirements for the power of the lamp in different scenes, and the increasing in power is accompanied by a corresponding increasing in heat.

As the main heat dissipation component of lamps, the requirements for the heat sink are getting higher and higher with the development of high-performance lamps. The traditional heat sink is fixed in the lamp with relatively complicated structure with poor integrity and it is not easy to assemble into the lamp concisely. It is easy to damage the fins during the assembly process, and the stability of the radiator after installation cannot be guaranteed, thereby affecting its heat dissipation performance.

SUMMARY OF INVENTION

The present disclosure provides a lamp, which aims to improve the low heat dissipation efficiency and poor stability of existing lighting fixtures.

The present disclosure provides a lamp comprising a housing, a heat sink, a light source and at least a bracket. The heat sink is disposed within the housing. The light source is connected with the heat sink. The bracket is disposed within the housing, wherein the bracket includes a main body and a first fixing portion arranged along the outer edge of the main body. The main body of the bracket connected to a side surface of the heat sink is connected to the housing through the first fixing portion to dispose the heat sink in the housing.

In some embodiments, the main body is in a plane shape, and a preset angle is formed between the first fixing portion and the main body.

In some embodiments, the heat sink includes a heat pipe and a plurality of fins; the light source includes a light emitting end and a heat conducting end which is thermally connected to the heat pipe penetrated by the multiple fins, the multiple fins are arranged in parallel along the length direction of the heat pipe and far away the direction of the light source, and wherein the main body is plate-shaped and connected to the fins by welding, or the main body is plate-shaped and connected to the fins by clamping.

In some embodiments, the lamp comprises two brackets. The main body of one of the brackets is arranged parallel to the fins and is fixedly connected with the fins on the side closed to the light source, and the main body of the other bracket is fixed connected with the fins on the side far away from the light source. The first fixing portion faces an inner wall of the housing.

In some embodiments, the lamp comprises two brackets oppositely arranged at intervals, and the two brackets and the plurality of fins are perpendicular to each other and connected by welding.

In some embodiments, the main body is rectangular shaped. The number of the first fixing portion is four, and the four first fixing portions are respectively located on the four corners of the main body, which are perpendicular to the main body.

In some embodiments, the lamp further comprises a heat dissipation fan. The bracket further includes a second fixing portion at a preset angle to the main body, and the bracket is connected with the heat dissipation fan by the second fixing portion.

In some embodiments, the housing comprises a bottom cover, a top cover located above the bottom cover and connected to the bottom cover, a front cover located on one end of the bottom cover and connected to the bottom cover and the top cover, and a back cover located on the other end of the bottom cover and connected to the bottom cover and the top cover; wherein a first air hole is disposed on the bottom cover and a second air hole is disposed on the top cover.

In some embodiments, the lamp further comprises a heat transferring block in thermal conduction contact with the light source, the heat pipe includes a first heat conduction pipe in thermal conduction contact with the heat transferring block and a second heat conduction pipe in thermal conduction contact with the heat transferring block, and the position of the first heat transferring pipe in thermal contact with the heat transferring block is closer to light source than the position of the second heat transferring pipe in thermal contact with the heat transferring block.

In some embodiments, the lamp further comprises a circuit board electrically connected to the light source; and the circuit board is mounted on the mounting platform disposed on the heat sink.

The lamp the present disclosure provided has the following advantages. The bracket is disposed within the housing, and the bracket includes a main body and a first fixing portion arranged along the outer edge of the main body. The main body of the bracket connected to a side surface of the heat sink is connected to the housing through the first fixing portion to dispose the heat sink in the housing. When the bracket is fixedly connected to the inner wall of the housing, the heat sink can be firmly installed inside the housing and it is not easy to loosen during use, so that the heat sink can continuously and stably dissipate for the lamp.

DESCRIPTION OF DRAWINGS

In order to explain the technical solutions in the embodiments of the present disclosure more clearly, the following will briefly introduce the drawings that need to be used in the description of the embodiments or the prior art. Obviously, the drawings in the following description are only for some embodiments, those of ordinary skill in the art can obtain other drawings based on these drawings without creative effort.

Figure 1:
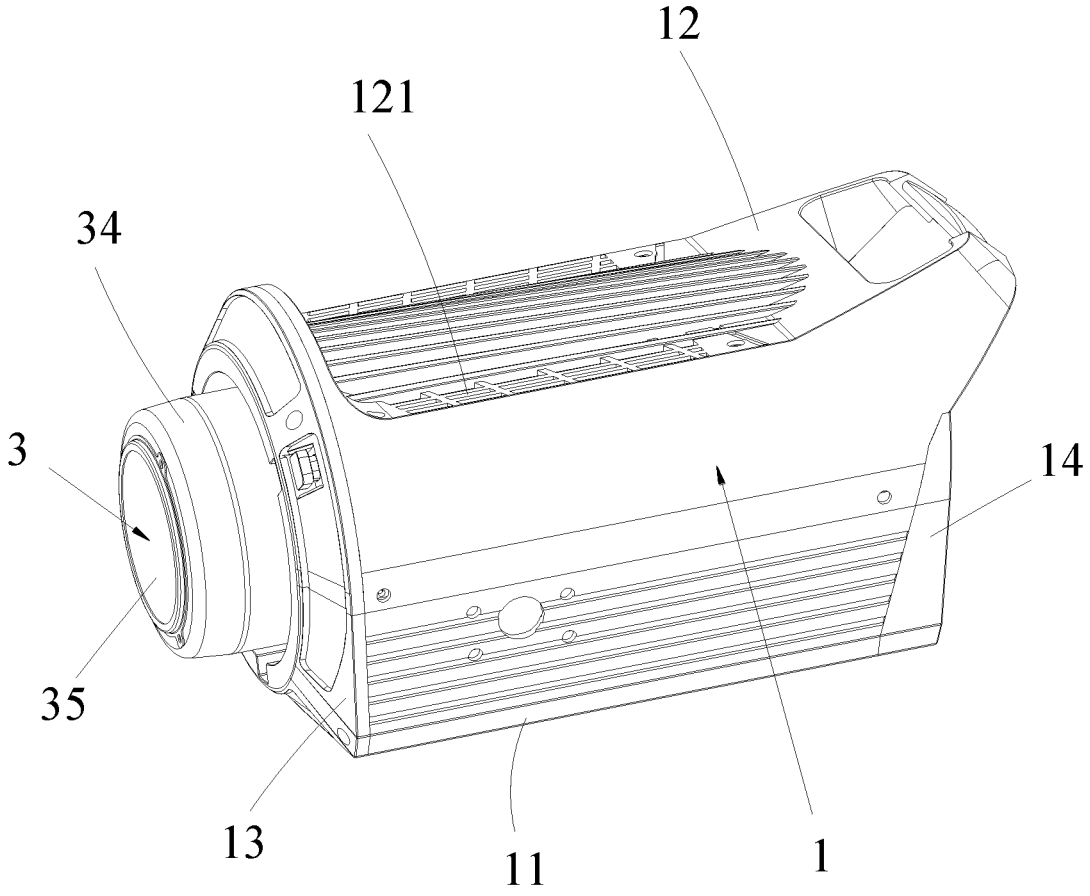
FIG. 1 is schematic diagram showing the structure of a lamp according to one embodiment of the present disclosure.

In the figures, every reference number refers to the following: 1, housing; 11, bottom cover; 111, first air hole; 12, top cover; 121, second air hole; 13, front cover; 14, back cover; 2, heat sink; 21, heat pipe; 211, first heat conduction pipe; 212, second heat conduction pipe; 22, fins; 3, light source; 31 light emitting end; 32, heat conducting end; 33, COB light source; 34, protecting cover; 35, optical lens; 4, Bracket; 41, main body; 42, first fixing portion; 421, first connecting hole; 43, second fixing portion; 431, second connecting hole; 44, relief hole; 5. heat dissipation fan; 6. heat transferring block; 7. circuit board; 8. mounting platform.

DETAILED DESCRIPTION OF PREFERRED EMBODIMENTS

In order to make the purpose, technical solutions, and advantages of the present disclosure more clearly, the following further describes the disclosure in detail with reference to the accompanying drawings and embodiments. It is obvious that the following embodiments are only some embodiments of the present invention, but should not be understood as a limitation to the present disclosure.

It should be noted that when an element is referred to as being "fixed to" or "disposed on" another element, it can be directly or indirectly on the other element. When an element is referred to be "connected to" another element, it can be directly or indirectly connected to the other element.

In the description of the present disclosure, it is to be understood that the orientation or positional relationship indicated by the terms such as "length", "width", "up", "down", "front", "behind", "left", "right", "vertical", "horizontal", "top", "bottom", "inner", "outer" etc. is based on the orientation or positional relationship shown in the drawings, and is only for convenience of description of the present application and simplified description, which is not indicating or implying that the device or component referred to must have a particular orientation, constructed and operated in a particular orientation, thus it is not to be construed as limiting the present disclosure.

Moreover, the terms "first" and "second" are used for descriptive purposes only and are not to be construed as indicating or implying a relative importance or implicitly indicating the number of technical features indicated. Thus, features defining "first" or "second" may include one or more of the described features either explicitly or implicitly. In the description of the present application, the meaning of "a plurality" is two or more unless specifically and specifically defined otherwise.

The following content combines with the drawings and the embodiment for describing the present disclosure in detail.

Figure 2:
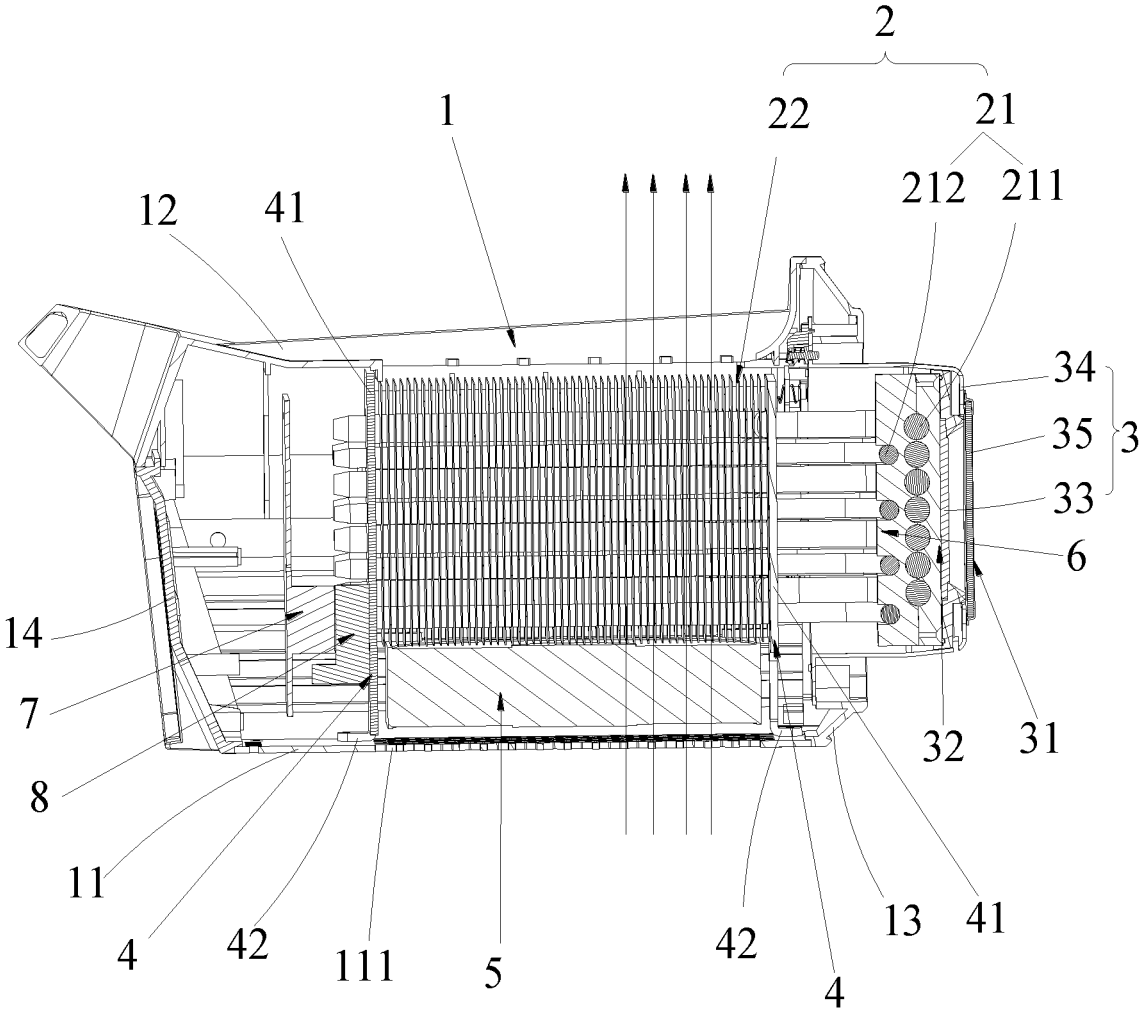
FIG. 2 is cross-sectional view of the lamp in FIG. 1.
Figure 3:
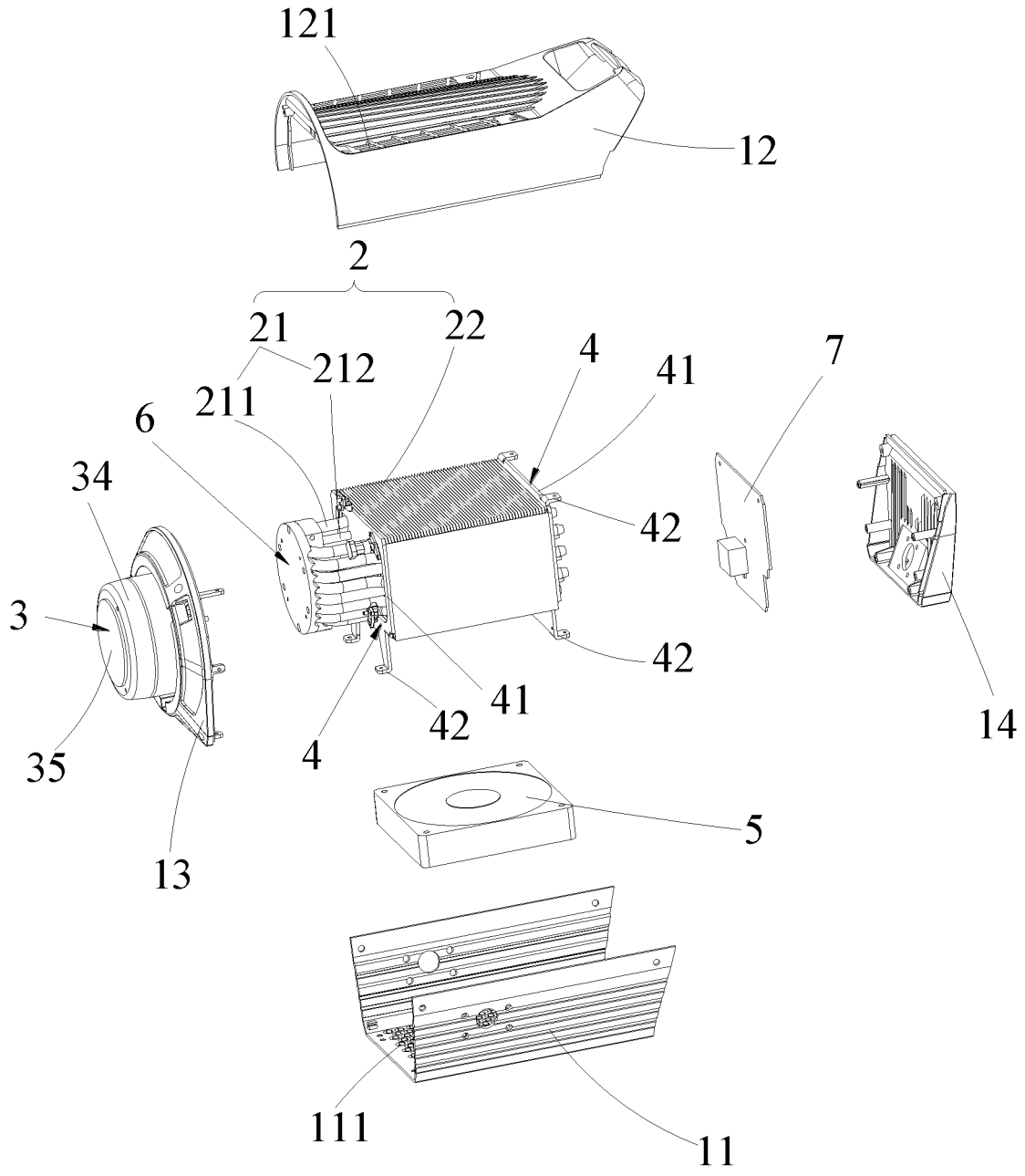
FIG. 3 is an exploded view of the lamp in FIG. 1.

As shown in FIG. 1-FIG. 3, an embodiment of the present disclosure provides a lamp comprising a housing 1, a heat sink 2, a light source 3 and at least a bracket 4. The heat sink 2 is disposed within the housing 1. The light source 3 is connected with the heat sink 2. The bracket 4 is disposed within the housing 1, wherein the bracket 4 includes a main body 41 and a first fixing portion 42 arranged along the outer edge of the main body 42. The main body 41 of the bracket 4 connected to a side surface of the heat sink 2 is connected to the housing 1 by the first fixing portion 42 to dispose the heat sink 2 in the housing 1. The bracket 4 can be composed of metal or metal alloy. The housing 1 can be made of metal, metal alloy or hard plastic.

In some embodiments, the light source 3 is a light emitting diode (LED) array, wherein the LED array includes a plurality of independent light emitting diodes so as to form a single high-brightness light emitting surface. The LED array can be arranged on a substrate with high thermal conductivity such as a metal substrate or a ceramic substrate. For example, a COB light source 33 packaged by COB (Chips on Board) technology may be used.

In other embodiments, other types of light sources 3 such as laser diodes etc. are also contemplated. It is understandable that the number of light sources 3 is not limited here. For example, it may be a single or multiple high-brightness light-emitting diodes, multiple light-emitting diode arrays, single or multiple organic light-emitting diodes, organic light-emitting diode arrays, single or multiple light-emitting diodes, and laser diode or laser diode array, etc. The light source 3 has a light emitting end 31 and a heat conducting end portion 32, and the heat conducting end 32 is thermally connected to the heat sink 2 to transfer heat to the heat sink 2 for heat dissipation.

In the embodiment of the present disclosure, the heat sink 2 is in thermal contact with the light source 3 to achieve the absorption of heat from the heat source for heat dissipation. The heat sink 2 includes a heat pipe 21 and a plurality of fins 22. The fins 22 are far away from the light source 3. The fins 22 are arranged in parallel and spaced along the length of the heat pipe 21 and perpendicular to the heat pipe 21. The heat pipe 21 can be made of copper or the like. The fin 22 can be made of a material with good heat dissipation performance such as aluminum. When the fins 22 are made of aluminum, aluminum is lighter than copper to effectively reduce the overall weight. Of course, the fins 22 may alternatively be made of other suitable materials (which have sufficiently high thermal conductivity and low weight), which is obvious to those skilled in the art. For example, other metals (such as iron or other alloys) are suitable, and even some non-metallic materials (including graphite or other carbon-based materials with high thermal conductivity). Especially for heat sources with severe heat generation, the heat can be quickly transferred to the fins 22 to dissipated.

The bracket 4 is disposed in the housing 1. The bracket 4 includes a main body 41 and a first fixing portion 42 arranged along the outer edge of the main body 41. The main body 41 and the first fixing portion 42 may be integrally formed. The main body 41 of the bracket 4 is connected to a side surface of the heat sink 2. For example, the main body 41 can be fixedly connected to the fins 22 (such as welding, clamping, etc.), or the main body can be fixedly connected to the heat pipe 21 (such as welding, clamping, etc.). The bracket 4 is connected to the housing 1 by the first fixing portion 42 to disposed the heat sink 2 in the housing 1. The simplified structure of the bracket 4 and the convenient and efficient fixing method make the assembly efficiency of the heat sink 2 effectively improved. The fixing portion 42 is fixed to the inner wall of the housing 1 and then firmly fixed to the heat sink 2 in the circumferential direction. When the bracket 4 is fixedly connected to the inner wall of the housing 1, the heat sink 2 can be firmly installed inside the housing 1, and it is not easy to loosen during working process to continuously and stably dissipate heat of the lamp.

Figure 5:
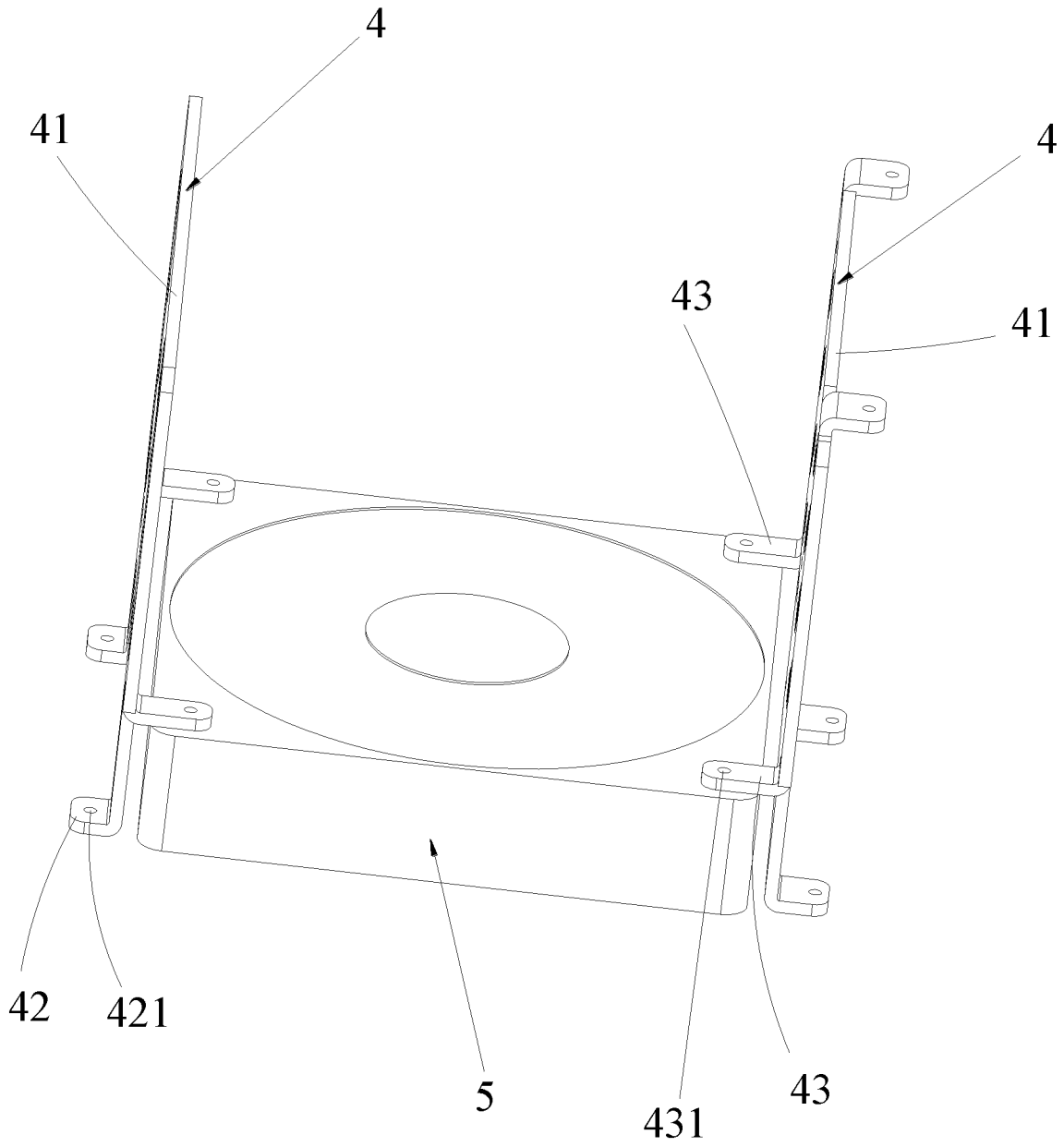
FIG. 5 is a schematic diagram showing the process of installing a heat dissipation fan on the bracket according to one embodiment of the present disclosure.

Please refer to FIG. 5, as another specific embodiment of the lamp provided in the present disclosure, the main body 41 is planar or substantially planar, and a present is predetermined between the first fixing portion 42 and the main body 4 such as just vertical or generally vertical. The planar main body 41 can make better contact with the fins 22, or facilitate the penetration and fixation of the heat pipe 21, thereby providing uniform support to the heat sink 2 so that the heat sink 2 is firmly supported without damage by the bracket 4 to ensure the structural integrity of the heat sink 2 and continuously maintain better heat dissipation performance.

Please refer to FIG. 2, as another specific embodiment of the lamp provided in the present disclosure, the heat sink 2 includes a heat pipe 21 and a plurality of fins 22. The light source 3 includes a light emitting end 31 and a heat conducting end 32. The heat conducting end 32 is thermally connected to the heat pipe 21. The heat pipe 21 passes through the plurality of fins 22. The fins 22 are arranged in parallel along the length direction of the heat pipe 21 and away from the light source 3. The main body 41 is plate-shaped and connected to the fins 22 by welding, or the main body 41 is plate-shaped and is connected to the fins 22 by clamping, or the main body 41 is connected to the heat pipe 21 by welding. There is a gap between the light source 3 and the fin 22. An escape hole corresponding to the heat pipe 21 is disposed on the bracket 4, and the heat pipe 21 is connected to the heat conducting end 32 of the light source 3 after passing through the fin 22 and the bracket 4. A plurality of fins 22 can be arranged in parallel with each other in sequence, and formed into a whole by the supporting and fixing effect of the heat pipe 21 and the bracket 4. The connection between the heat sink 2 and the bracket 4 is stable during use. Therefore, when the bracket 4 is firmly installed inside the housing 1, the heat sink 2 can also be fixed in the housing 1 stably without easily damaged, thereby the heat dissipation performance can be guaranteed.

Please refer to FIG. 2, as another specific embodiment of the lamp provided in the present disclosure, the lamp comprises two brackets 4. The main body 41 of one bracket 4 is arranged parallel to the fins 22 and fixedly connected to the fins 22 that is close to the light source. The main body 41 of the other bracket 4 is fixedly connected to the fin 22 farthest away from the light source 3 among the fins 22, and the first fixing portion 42 faces an inner wall of the housing 1. Viewed along the length direction of the heat pipe 21, the two brackets 4 are respectively arranged in front and rear. Of course, in other embodiments, one bracket 4 can be fixedly connected to at least part of the fins or all of the fins 22, that is, the bracket 4 and the fins 22 are arranged perpendicularly. It is understandable that the bracket 4 is arranged on the sides of the plurality fins 22 at this time. And another bracket 4 is correspondingly arranged on the opposite side or adjacent side of the plurality of fins 22. When viewed along the length of the heat pipe 21, the two brackets 4 are arranged up and down or left and right respectively. Therefore, the two brackets 4 can support the heat sink 2 better so that the heat sink 2 can be firmly installed in the housing 1. When the two brackets 4 are located at opposite ends of the plurality of fins 22 and are perpendicular to the heat pipe 21, the brackets 4 only contacts with the outer side fins 22 and it is not easy to damage the other fins 22. The fins 22 can Maintain good heat dissipation performance.

Please refer to FIG. 2, as another specific embodiment of the lamp provided in the present disclosure, the lamp comprises two brackets 4. The two brackets 4 are arranged oppositely at intervals. The two brackets 4 and the plurality of fins 22 are perpendicular to each other and connected by welding. That is, in this embodiment, the main bodies 41 of the brackets 4 are perpendicular to the fins 22, and the main bodies of the brackets can be parallel with the heat pipe 21. Since the brackets 4 have a certain length, the brackets 4 can cover a plurality of fins 22 and be welded with the plurality of fins 22 to achieve the integration of the fins 22 and the brackets 4, so that the fins 22 are not easily damaged and can maintained continuously better heat dissipation performance.

Figure 4:
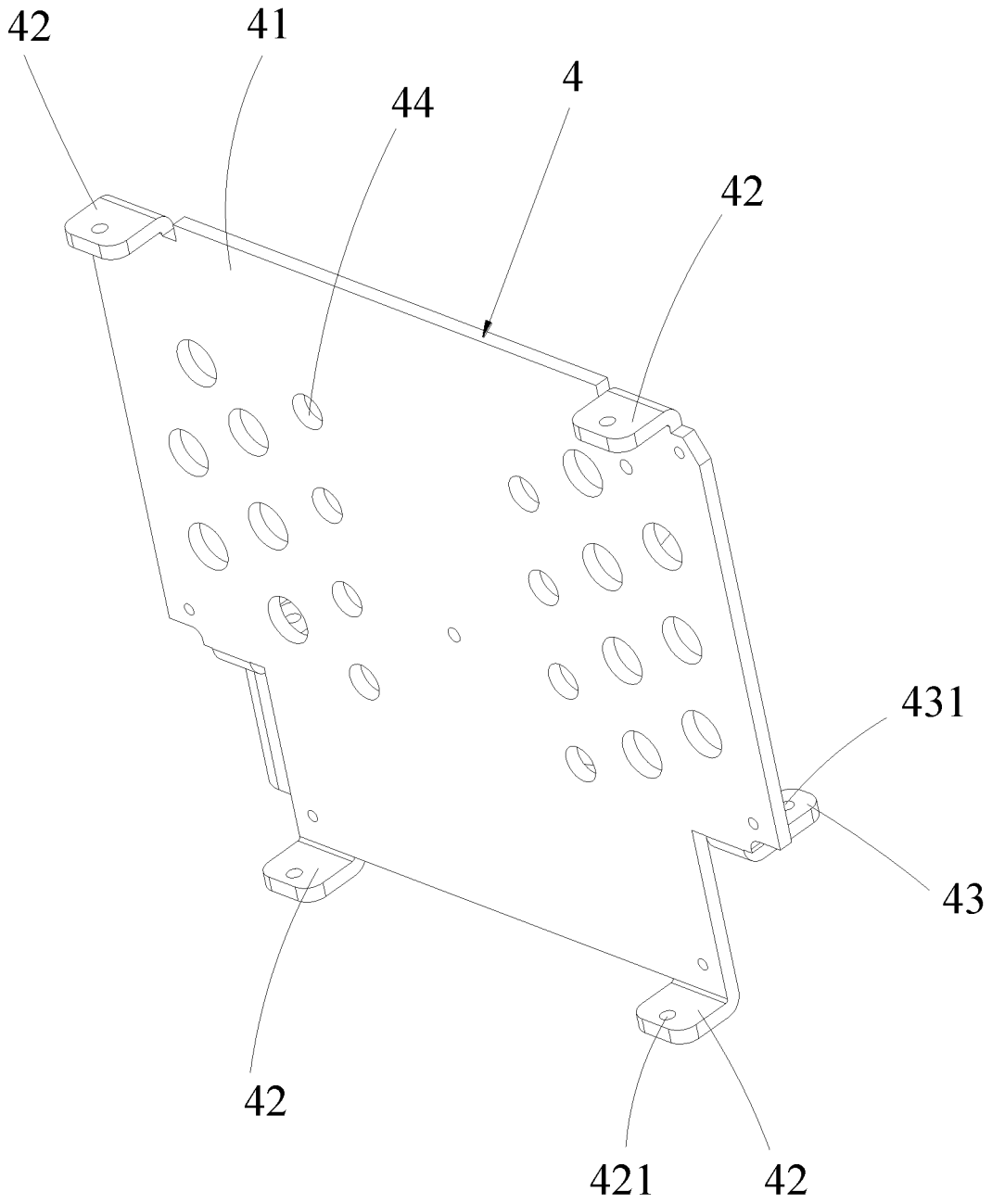
FIG. 4 is a schematic diagram of the structure of the bracket according to one embodiment of the present disclosure.

Please refer to FIG. 4, as another specific embodiment of the lamp provided in the present disclosure, the main body 41 is rectangular, the number of the first fixing portions 42 is four, and the four first fixing portions 42 are respectively located on the four sides of the main body 41. At each corner, the first fixing portion 42 and the main body portion 41 are perpendicular to each other. It can be understood that each of the first fixing portions 42 on the four corners of the main body 41 extends to the top and bottom of the main body 41 respectively; or may also extend to the left and right sides of the main body 41 respectively. When extending to the top and bottom of the main body 41, the bracket 4 can be connected to the bottom and the inner walls of the bottom of the housing 1 by the first fixing portion 42 to achieve the connection between the bracket 4 and the housing 1. When extending to the left and right sides of the main body 41, the bracket 4 can be connected to the inner wall of the side plate of the housing 1 by the first fixing portion 42 to achieve the connection between the bracket 4 and the housing 1.

In some embodiments, the first fixing portion 42 is in the shape of a long plate, and may be provided with a first connecting hole 421 which is connected to the inner wall of the housing 1 by screws. It is perpendicular to the plane of the main body 41 in length direction; and is distributed on a pair of sides of the main body 41. For example, two long plates are sufficient. Of course, more sides and more (three, four) long plate-like structures are also feasible. Thus, the stability of the connection can be ensured. The first fixing portion 42 can also be a block structure arranged at intervals on the outer edge of the main body. The block structure is provided with fixing holes and distributed on a pair of sides of the main body 41. Comprehensively considered from the perspective of fixing stability and saving materials, disposing on a pair of sides of the main body 41 and two block structures on each side is better. Of course, the number of each side can also be decided according to needs, for example, one, three, four, etc. The first fixing portion 42 and the housing 1 can be fixedly connected by fasteners such as bolts or chute clamping. Optionally, the first fixing portion 42 may also be a plurality of spaced convex portions, and a groove portion is disposed on the inner wall of the housing 1, then the convex portion is inserted into the groove portion to achieve clamping and fixing, thereby improving the efficiency of lamp assembly.

Please refer to FIG. 2 and FIG. 5, as another specific embodiment of the lamp provided in the present disclosure, the lamp comprises a heat dissipation fan 5 between the two brackets 4. The bracket 4 further includes a second fixing portion 43 at a predetermined angle to the main body 41, and the bracket 4 is connected to the heat dissipation fan 5 through the second fixing portion 43. The heat dissipation fan 5 can accelerate the flow speed of the airflow on the surface of the heat sink 2 to improve the efficiency of heat exchange. Optionally, the second fixing portion 43 and the main body 41 are vertically arranged, and the second fixing portion 43 can be better attached to the heat dissipation fan 5 and better connected to the heat dissipation fan 5 (when the second fixing portion 43 is in a flat plate shape, a second connecting hole 431 can be opened, and the fixed connection can be realized by means of screws). When the heat dissipation fan 5 is connected to the two brackets 4, it can be connected between the brackets 4 as a support to improve the stability of the brackets 4 themselves. A rubber ring can be arranged at the joint of the heat dissipation fan 5 to make the fixing more stable and effectively reduce the noise caused by vibration.

Please refer to FIG. 3, as another specific embodiment of the lamp provided in the present disclosure, the housing 1 comprises a bottom cover 11, a top cover 12 located above the bottom cover 11 and connected to the bottom cover 11, a front cover 13 located on one end of the bottom cover 11 and connected to the bottom cover 11 and the top cover 12, and a back cover 14 located on the other end of the bottom cover 11 and connected to the bottom cover 11 and the top cover 12. A first air hole 111 is disposed on the bottom cover 11 and a second air hole 121 is disposed on the top cover 12. Any one of the first air hole 111 and the second air hole 121 may be an air inlet, and the other may be an air outlet. The heat dissipation fan 5 can work in two ways. First, the heat dissipation fan 5 sucks external air into the housing 1 through the air inlet (for example, the first air hole 111), and the hot air in the housing 1 can pass through the air hole and (for example, the second air hole 121) leave the housing 1. The other is that heat dissipation fan 5 discharges the air in the housing 1 through the air outlet (for example, the second air hole 121), and the air outside flows into the housing 1 through the air inlet (for example, the first air hole 111). The above two methods can achieve the convection of the air inside and outside the housing 1 so that the temperature in the housing 1 is not too high. The heat dissipation fan 5 is separated from the first air hole 111 by a predetermined distance to effectively reduce the air duct noise related to the operation of the heat dissipation fan 5. Moreover, protrusions or grooves can be disposed on the surface of the housing 1 to increase the heat exchange area of the outer surface of the housing 1 to further improve the heat dissipation performance.

Please refer to FIG. 2-FIG. 4, as another specific embodiment of the lamp provided in the present disclosure, the lamp further comprises a heat transferring block 6 in thermal conduction contact with the light source 3. The heat pipe 21 includes a first heat conduction pipe 211 in thermal conduction contact with the heat transferring block 6 and a second heat conduction pipe 212 in thermal conduction contact with the heat transferring block 6. The position of the first heat transferring pipe 212 in thermal contact with the heat transferring block 6 is closer to light source 3 than the position of the second heat transferring pipe 212 in thermal contact with the heat transferring block 6. The heat transfer block 6 can be made of copper or other materials with better thermal conductivity. The heat transfer block 6 can increase the contacting area between the heat pipe 21 and the light source 3 so that the heat of the light source 3 can be transferred to the heat pipe 21 in a large amount, and finally reaches the fin 22 far from the light source 3. A relief hole 44 adapted to the heat pipe 21 can be disposed on the bracket 4 to allow the heat pipe 21 to pass through. When the heat pipe 21 passes through the relief hole 44, the bracket 4 can form a certain supporting effect on the heat pipe 21, so that the heat pipe 21 can stably contact with the light source 3 and other heat sources. It is not easy to loosen during use. In other embodiments of the present disclosure, the light source 3 can also directly contact with the heat pipe 21.

Since the heat transferring block 6 has a certain thickness, the position where the first heat transferring pipe 211 is in thermal contact with the heat transfer block 6 is closer to the light source 3 than the position where the second heat transfer tube 212 contacts the heat transfer block 6, so that the heat of the heat transferring block can be better transferred. As an example, there are multiple of the first heat transferring pipe 211 and the second heat transferring pipe 212, and they are distributed in sequence along the height direction of the heat transferring block 6 to cover multiple positions of the heat transferring block 6 and then the heat can be directly transferred to the heat pipe 21.

Please refer to FIG. 2, as another specific embodiment of the lamp provided in the present disclosure, the lamp further comprises a circuit board 7 electrically connected to the light source 3, and the circuit board 7 is mounted on the mounting platform 8 disposed on the heat sink 2. The mounting table can be made of copper and other materials with good thermal conductivity. The circuit board 7 includes a PCB (Printed Circuit Board). The circuit board 7 is used to generate a signal to control the light source 3, such as controlling the magnitude of related current and adjusting brightness and other operations. The circuit board 7 and the light source 3 can be located at opposite ends of the heat sink 2 respectively, and then transfer heat to the opposite ends of the heat sink 2 respectively. Specifically, the heat of the circuit board 7 is transferred to the mounting platform which receives the heat to transferred to the fins 22. The fins 22 then radiate the heat outward.

Please refer to FIG. 2, as another specific embodiment of the lamp provided in the present disclosure, the light source 3 also includes a protective cover 34 connected to the housing 1 and arranged around the light source 3, and an optical lens 35 installed on the protective cover 34 and arranged opposite to the light source 3. The protective cover 34 may be an aluminum cover, which has high strength and light weight and can dissipate part of the heat generated by the light source 3 into the air. After the light emitted by the light source 3 passes through the optical lens 35, the emitted light becomes softer.

It is understandable that the solution in another specific embodiment manner may be an achievable implementation solution that is further improved on the basis of other embodiments.

While the present disclosure has been described with the embodiments, it is preferable that the above embodiments should not be construed as limiting of the present disclosure. On the contrary, the present disclosure includes all the modifications and variations without departing from the spirit and scope of the present disclosure.

What is claimed is:

1. A lamp comprising:

a housing;

a heat sink disposed within the housing;

a light source connected with the heat sink; and at least a bracket disposed within the housing, wherein the bracket includes a main body and a first fixing portion arranged along the outer edge of the main body, the main body of the bracket is connected to a side surface of the heat sink, and the main body of the bracket is connected to the housing through the first fixing portion to dispose the heat sink in the housing;

wherein the heat sink includes a heat pipe and a plurality of fins; the light source includes a light emitting end and a heat conducting end which is thermally connected to the heat pipe penetrated by the multiple fins the multiple fins are arranged in parallel along the length direction of the heat pipe and far away the direction of the light source, and wherein the main body is plate-shaped and connected to the fins by welding, or the main body is plate-shaped and connected to the fins by clamping.

2. The lamp as claimed in claim 1, wherein the main body is in a plane shape, and a preset angle is formed between the first fixing portion and the main body.

3. The lamp as claimed in claim 1, wherein the bracket is two brackets, the main body of one of the brackets is arranged parallel to the fins and is fixedly connected with the fins on the side closed to the light source, the main body of the other bracket is fixed connected with the fins on the side far away from the light source, and the first fixing portion faces an inner wall of the housing.

4. The lamp as claimed in claim 1, wherein the bracket is two brackets oppositely arranged at intervals and the two brackets and the plurality of fins are perpendicular to each other and connected by welding.

5. The lamp as claimed in claim 2, wherein the main body is rectangular shaped, the number of the first fixing portion is four, and the four first fixing portions are respectively located on the four corners of the main body, which are perpendicular to the main body.

6. The lamp as claimed in claim 1, wherein the lamp further comprises a heat dissipation fan, the bracket further includes a second fixing portion at a preset angle to the main body, and the bracket closed to one side of the heat sink is connected with the heat dissipation fan by the second fixing portion and.

7. The lamp as claimed in claim 6, wherein the housing comprises a bottom cover a top cover located above the bottom cover and connected to the bottom cover, a front cover located on one end of the bottom cover and connected to the bottom cover and the top cover, and a back cover located on the other end of the bottom cover and connected to the bottom cover and the top cover; wherein a first air hole is disposed on the bottom cover and a second air hole is disposed on the top cover.

8. The lamp as claimed in claim 1, wherein the lamp further comprises a heat transferring block in thermal conduction contact with the light source, the heat pipe includes a first heat conduction pipe in thermal conduction contact with the heat transferring block and a second heat conduction pipe in thermal conduction contact with the heat transferring block, and the position of the first heat transferring pipe in thermal contact with the heat transferring block is closer to light source than the position of the second heat transferring pipe in thermal contact with the heat transferring block.

9. The lamp as claimed in claim 1, further comprising a circuit board electrically connected to the light source; and the circuit board is mounted on the mounting platform disposed on the heat sink.

* * * * *